United States Patent [19]

Vackier

[11] Patent Number: 4,515,461

[45] Date of Patent: May 7, 1985

[54] APPARATUS FOR TRANSFERRING ELECTROPHOTOGRAPHIC IMAGES

[75] Inventor: Leo N. Vackier, 's-Gravenwezel, Belgium

[73] Assignee: AGFA-Gevaert N.V., Mortsel, Belgium

[21] Appl. No.: 498,156

[22] Filed: May 25, 1983

[30] Foreign Application Priority Data

May 26, 1982 [GB] United Kingdom ..... 8215316

[51] Int. Cl.[3] ..... G03G 15/00

[52] U.S. Cl. ..... 355/3 TR; 355/16; 355/3 R

[58] Field of Search ..... 355/3 R, 16, 35 H, 11, 355/64–66, 3 TR, 72–74; 101/DIG. 13

[56] References Cited

U.S. PATENT DOCUMENTS 4,402,592 9/1983 Schön et al. ..... 355/3 R

*Primary Examiner*—Richard L. Moses

*Attorney, Agent, or Firm*—William J. Daniel

[57] ABSTRACT

Electrophotographic image transfer apparatus wherein a toner image on an image-donating element, e.g., previously uniformly charged and image-wise exposed photoconductor sheet, is transferred to a receptor element. Exact parallelism between both elements during such passage through a toner transfer zone is obtained by fitting one element onto a rotatable cylindrical member, fitting the other element to a flat holder that is carried tangentially of the cylindrical member, mounting the flat holder for balancing about a pivot axis which runs parallel with the direction of holder movement, providing two laterally spaced spacing strips to control the gap between the two elements, and biasing the flat holder towards the cylindrical supporting member with the spacer strips therebetween.

The apparatus is principally intended for producing large-size lithographic aluminum printing plates.

13 Claims, 7 Drawing Figures

APPARATUS FOR TRANSFERRING ELECTROPHOTOGRAPHIC IMAGES

Figure 1:
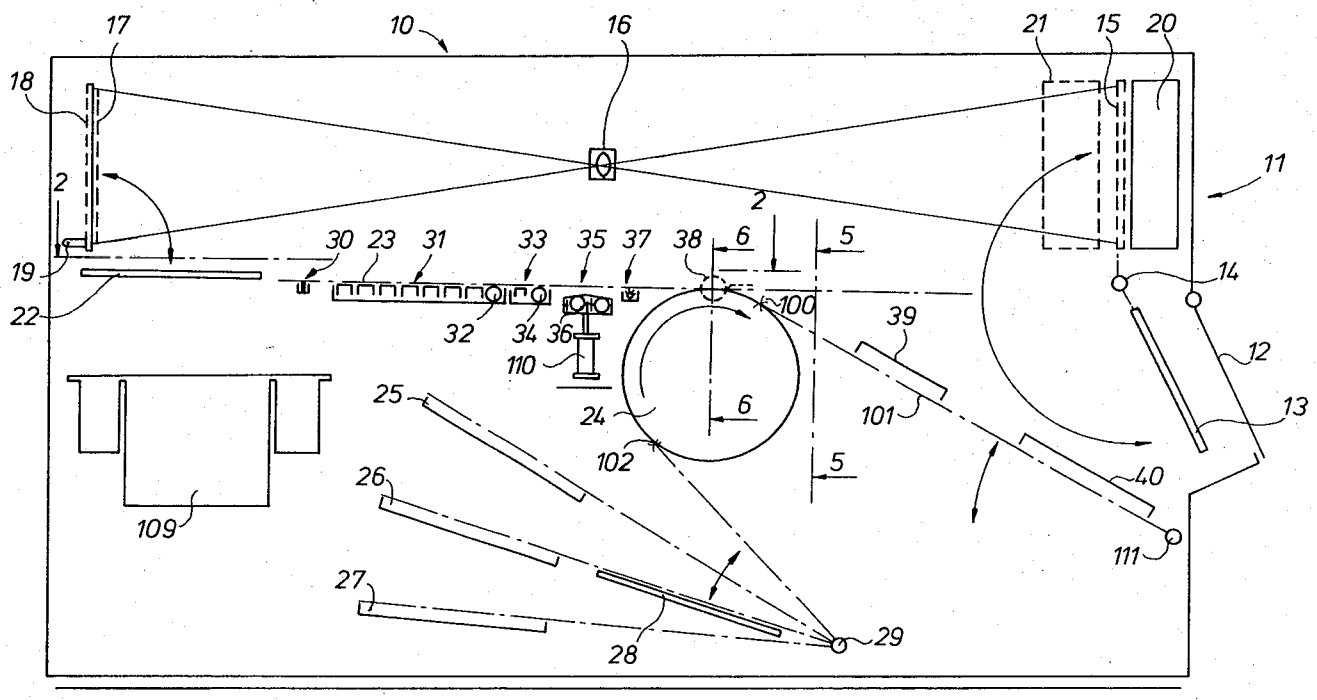

Various reprographic processes involve progressive image transfer to or from a cylindrically curved surface rotating about its axis of curvature. Such transfer may take place from or to a flat surface in tangential relationship to such curved surface or from or to a second cylindrically curved surface rotating about its axis of curvature synchronously with the first one.

Such an image transfer procedure occurs for example in rotary offset printing machines. Another well known application of such an image transfer procedure is in xerographic document copiers in which an electrostatic image is formed on a photoconductive layer on the surface of a drum and developing toner applied to the drum is transferred under the influence of an electrical field to plain paper receptor sheets.

In the known processes the progressive image transfer takes place during rolling contact between the surfaces which respectively donate and receive the image (see e.g. U.S. Pat. No. 3,071,070 and UK Patent Application GB No. 2 003 090 A, which latter specification relates both to offset duplicating and to xerographic printers).

In the field of xerographic printing, toner image transfer under rolling contact pressure between the toner image-carrying and toner image-receiving surfaces requires the observance of certain process conditions which sometimes inconveniently restrict the kinds of materials which can be used. For example the rolling contact condition is not very suitable for transferring liquid toner, whether a pure liquid or a dispersion of toner particles in a liquid carrier. The need for the rolling contact also restricts the choice of materials for the co-operating image-donating and image-receiving surfaces. For example, when toner images have to be transferrred to image-receiving sheets from a photoconductive element, the receptor sheets must be composed so that they do not cause damage to the photoconductive surface, which is usually not very resistant to mechanical damage. Normally, no problems arise when using plain paper receptor sheets, but it is not always suitable to use receptor sheets of that kind. A specific type of reprographic work in which toner transfer under rolling pressure contact is to be avoided if possible is the transfer of toner images from photoconductive elements to metal receptor sheets, e.g. sheets of uncoated anodised aluminium as used for the production of planographic printing plates. Such plates have a rough aluminium oxide surface which provides minute pores or recesses for toner particle retention and the surface is somewhat abrasive.

These considerations point to the need for an apparatus whereby a toner image can be progressively transferred to or from a rotating cylindrically curved surface, from or to the image-donating or image-receiving surface as the case may be, without the necessity for pressure contact between such surfaces.

It is known that a toner image can be electrostatically transferred across a gap between the toner-carrying surface and the surface of a receptor. For achieving good transfer image quality however the gap size is critical. The gap has in general to be very small because lateral spreading of the toner, resulting in unsharpness of the transfer image, increases with the gap size. It is considered that in most circumstances a gap of between 15 and 50 microns is suitable. It is also important for the gap to be substantially constant over the whole area of the image. These conditions give rise to very considerable problems in devising an apparatus by which moving image-donating and image-receiving surfaces can be reliably guided in image-transfer relationship with the precision necessary for maintaining the required surface to surface gap.

Moreover the foregoing problem tends to be greater, the greater are the overall dimensions of the image to be transferred. The problem is for example very acute if a small critical gap has to be maintained over a distance (gap length) of approximately 1 meter. This would be a requirement for apparatus to be used in preparing lithographic printing plates of large size formats, say e.g. up to 915 by 635 mm, which is the size of an opened double-page large newspaper sheet. The design of apparatus suitable for use in preparing newspaper printing plates by toner image transfer involves accented problems because half-tone images are required and satisfactory prints can only be produced if the dots of the toner image formed with the aid of a half-tone screen are sharply defined. Therefore it is very important to avoid any significant toner spreading.

It is an object of the present invention to provide an apparatus having means which reliably establishes a predetermined toner transfer gap.

Another object of the invention is to provide apparatus which is very suitable for use in the production of planographic printing plates.

The apparatus of the invention includes a carriage guided for bodily movement past a rotatable member. The carriage can hold a toner image-bearing element e.g. a flexible photoconductor sheet, in flat condition, and the rotatable member can carry a receptor element, e.g. a printing plate blank. Alternatively a receptor element can be mounted on the carriage, in which case the toner transfer will take place from an element on the rotatable member, which element can for example be a photoconductive layer formed on the rotatable member or a photoconductor sheet attached thereto. The element holder of the carriage is biased towards the rotatable member as the carriage travels past the image transfer station and a gap is preserved between the image-donating and image-receiving surfaces by spacer strips provided on the carriage or the rotatable member.

The invention enables a transfer gap of appropriately small size to be established and maintained during the toner transfer operation by means which is simple and reliable.

The invention is primarily intended for apparatus to be used in the production of planograhic printing plates but it can also be embodied in apparatus for the production of high-grade copies on plain paper, plastics or other suitable supports. The apparatus can be used in the image-wise transfer of dry toner, or of liquid toner, whether a true liquid or a suspension of toner particles in a liquid carrier.

The spacer strips can be integral parts of the element holding component of the carriage or of the rotatable member, or they can be attached to such holder or member, either directly, or indirectly via an image-donating or image-receiving element fitted to such holder or member. It is suitable to use metal spacer strips.

Separately fabricated spacer strips can be directly or indirectly attached to the carriage or to the rotatable member in various ways. Preferably they are attached by adhesive, e.g. by strips of self-adhesive tape.

In preferred apparatus according to the invention, the element holder of the carriage is mounted so that it is free to rock in either direction about an axis parallel with the path of the carriage. This is a very advantageous feature because it introduces a measure of self-compensation for any slight disconformity which may exist, because of manufacturing tolerances, between the exposed surface of one or each spacer strip and a perfect notional cylindrical surface of predetermined radius.

It is particularly preferred for apparatus for the element holder of the carriage to be pivotally carried by a supporting means which is itself mounted in the holder for rocking movement about an axis parallel to the pivot axis between the holder and such supporting means. As will hereafter be explained with reference to a specific example of an apparatus incorporating these features, the presence of the two different pivotal axes enables the element holder to move bodily in directions normal to a tangent plane to the rotatable member, as well as to tilt laterally, while the carriage chassis remains free from such movements and keeps to its predetermined path of advance. Preferably these different pivot axes are located in a common horizontal plane so that slight bodily movements of the holder in such normal directions towards and away from that tangent plane can take place without causing lateral displacement of the holder with respect to its correct path of advance through the image transfer station. Any such lateral displacement would of course be likely to cause toner image spread or smear.

For the required bias of the element holding component of the carriage towards the rotatable member, reliance can be placed on gravity when the carriage and member are appropriately positioned. As hereafter exemplified counter-weighting factor can be introduced. By appropriate choice of the mass of the counterweight the contact pressure between the spacer strips and the surface portions with which they co-operate at the transfer station can be accurately predetermined.

It is very advantageous for the carriage to be supported by a guide track via the agency of air bearings. Such bearings enable the carriage to move substantially without frictional restraint, in a smooth manner, without vibration. The use of air bearings between relatively moving parts is well known per se.

Electrostatic latent imaes developable by application of liquid toner can be deposited on non-photoconductive insulating elements and such an element can be used as the toner image-donating element when performing an image transfer process in apparatus according to the present invention. However it is in general much more satisfactory to form the initial electrostatic image on a photoconductive element and such an element is preferably employed as the toner image-donating element.

An apparatus according to the invention may include one or more rotatable members additional to the one already mentioned, the rotatable members being arranged in succession along the path of the carriage. If each of the rotatable members carries a photoconductor element, toner developed images can be transferred from such elements to one and the same receptor sheet, conveyed through the plurality of transfer stations by the carriage. Such an apparatus is of potential value for the formation of multi-colour images by transferring to a receptor sheet a plurality of colour separation images (e.g. a blue, a green, a red and a black image) in exact register.

When using a photoconductor element it is advantageous for this to be a flexible sheet which can be held in a flat, stationary condition during image-wise exposure. The optical system employed for projecting a light image onto a flat sheet can be simpler than an optical system for projecting light images onto a rotating drum of the like. This is particularly the case for images of large size. That is one reason why it is an advantage to use the carriage for holding a photoconductor sheet. However a rotatable member which has means for releasably holding a flexible sheet can be used for supporting a flexible photoconductor sheet bearing a developed electrostatic charge image which has been formed while the sheet was held flat.

The cylindrically curved periphery of the rotatable member may subtend 360°, but this is not essential. Such surface can subtend a smaller angle. A very advantageous form of rotatable sheet support is one comprising segmental components having peripheral portions of intermeshing comb-like structure which together form the cylindrically curved sheet supporting surface, such components being relatively angularly displaceable for varying the dimension of such surface as measured along the line of its curvature. Such a sheet support, having means for holding a flexible sheet taut against the cylindrically curved surface, is described in co-pending European Patent Application No. 83 200 310.7 filed on Mar. 4, 1983.

Figure 2:
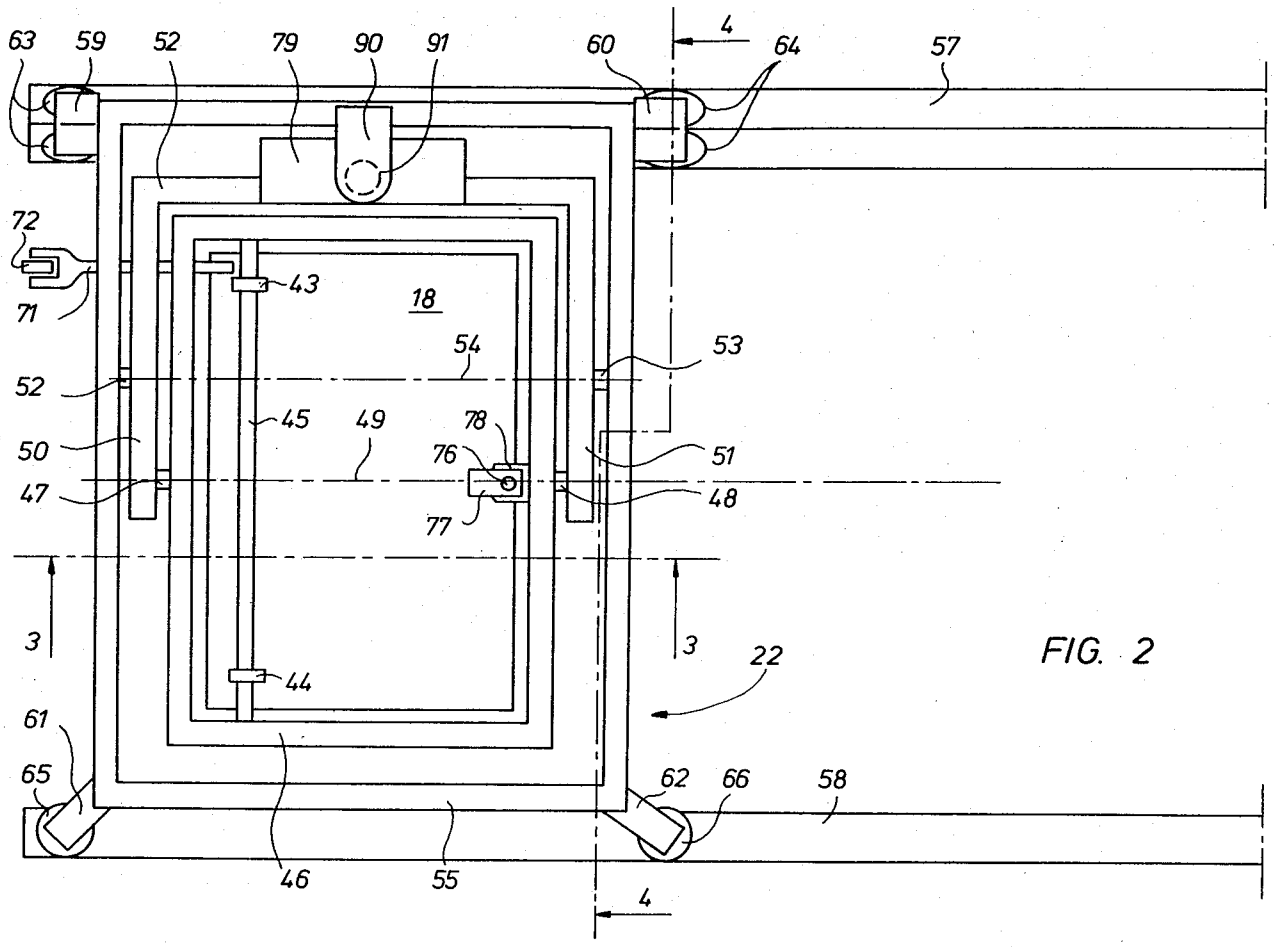
Figure 3:
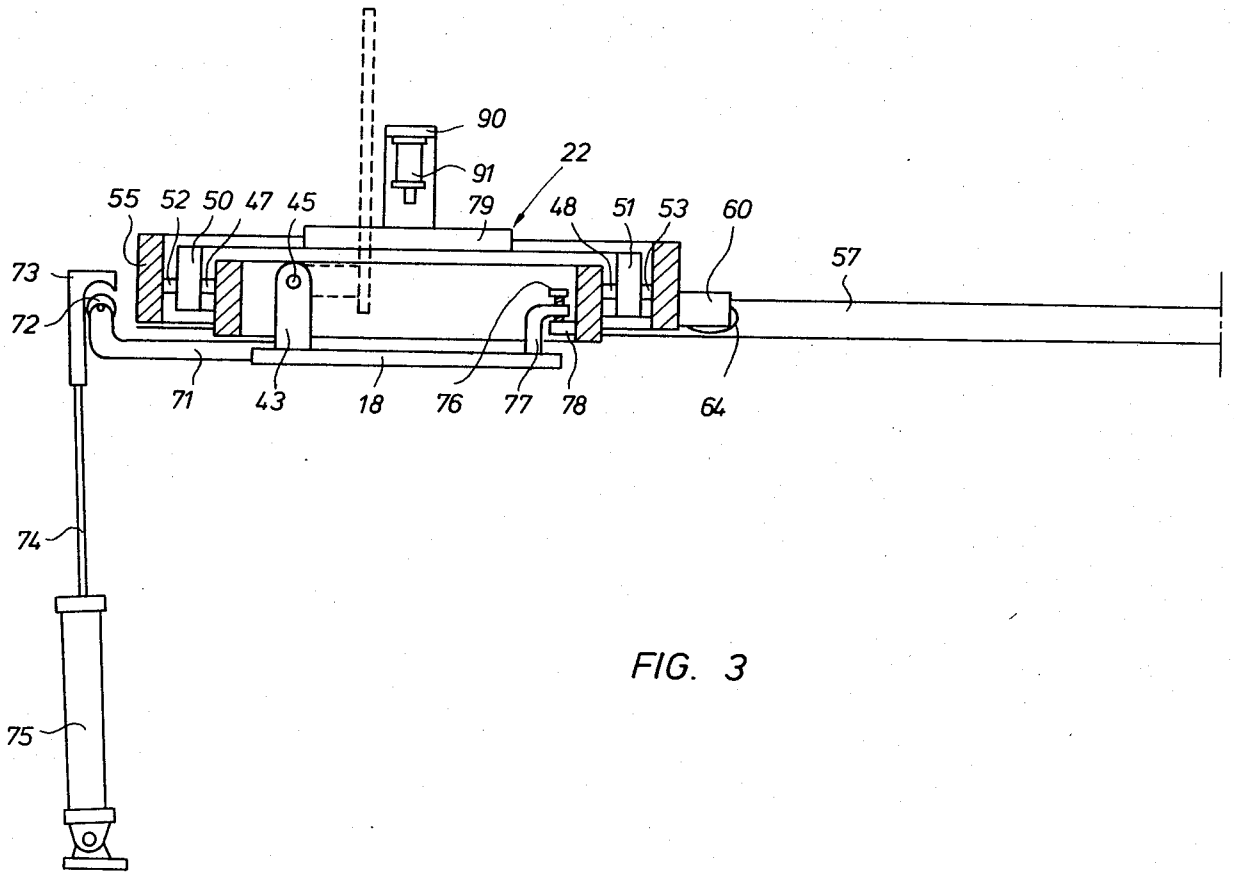
Figure 4:
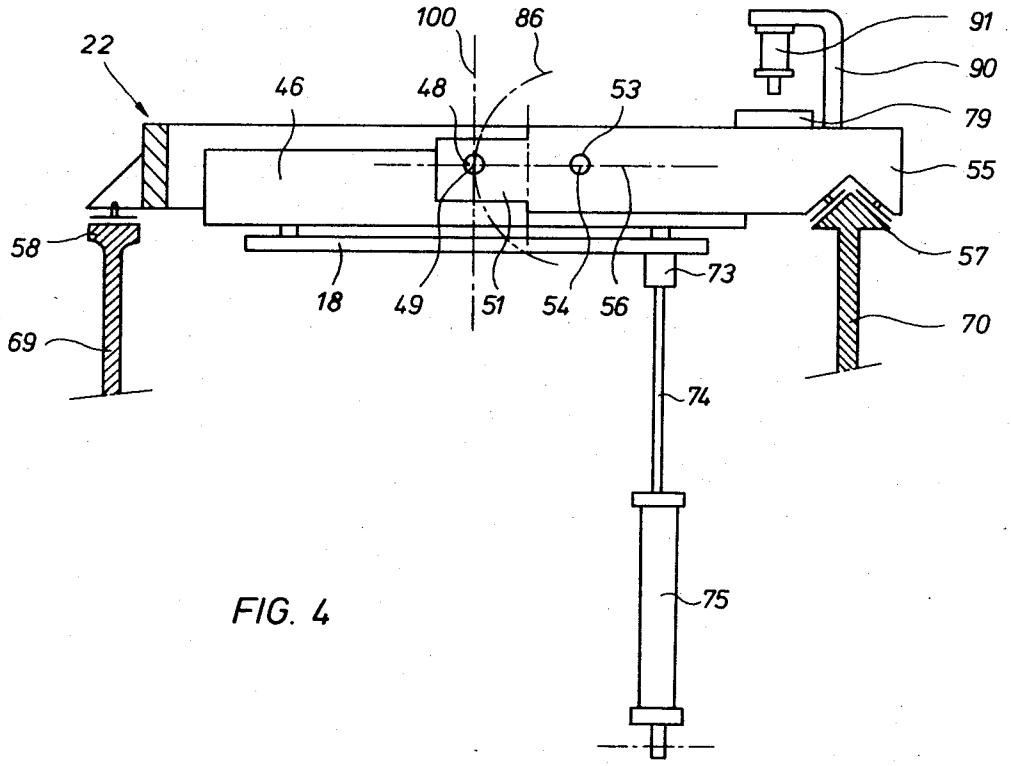
Figure 5:
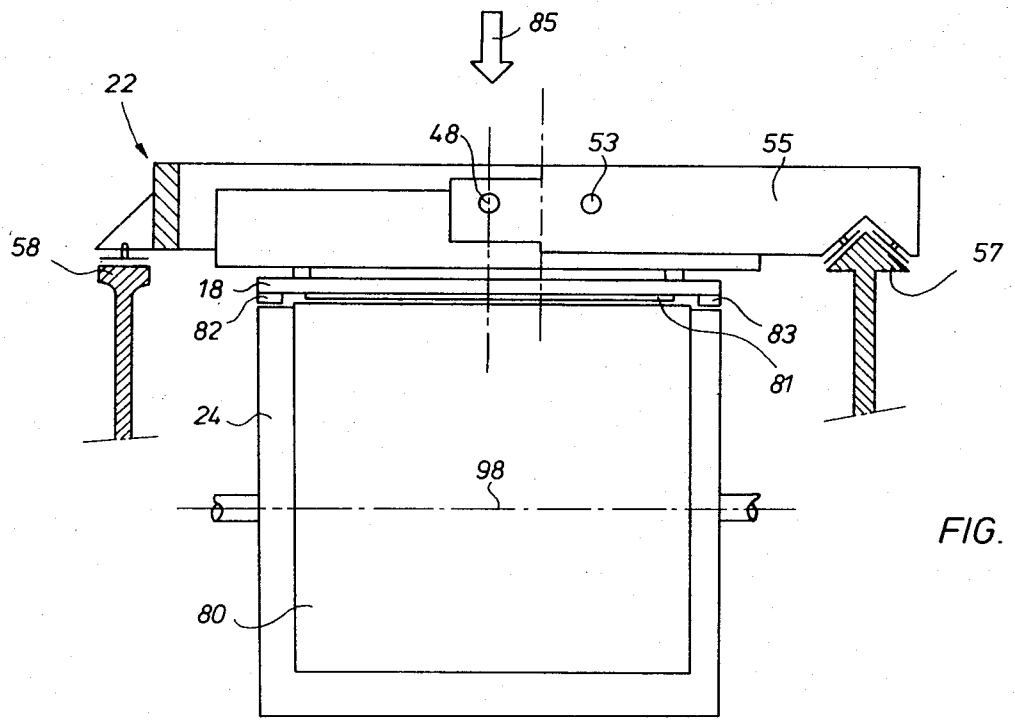

An example of apparatus according to the invention will be described with reference to the accompanying drawings, wherein:

FIG. 1 is a diagrammatic longitudinal sectional view through one embodiment of an apparatus according to the invention, FIG. 2 is a plan view on line 2—2 of FIG. 1 on an enlarged scale of the linearly movable carriage, FIG. 3 is a longitudinal sectional view on line 3—3 of FIG. 2, FIG. 4 is a transverse sectional view on line 4—4 of FIG. 2, FIG. 5 is a transverse sectional view on line 5—5 of FIG. 1

Figure 6:
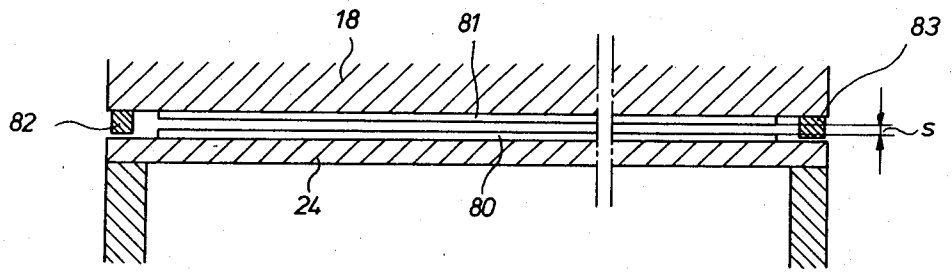
Figure 7:
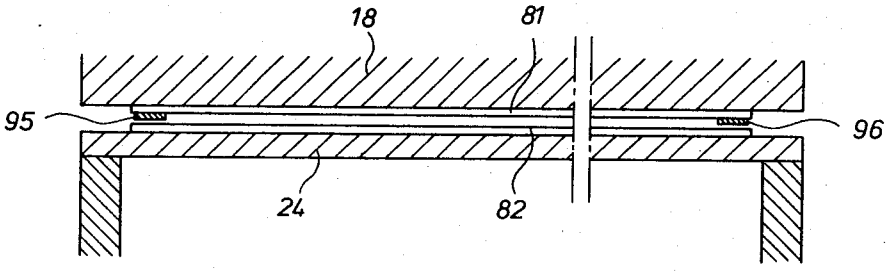

FIG. 6 is an enlarged view of the control of the toner transfer gap of FIG. 5, and FIG. 7 is an enlarged view of an other embodiment for the control of the toner transfer gap of FIG. 5.

Referring to FIG. 1 which shows a diagrammatic illustration of a lithographic platemaker, the apparatus is mounted within an elongated light-tight housing 10 that is provided at its frontside 11 with a rectangular, light-tightly closable panel 12 that permits an operator to fit a paste-up original to be reproduced onto a pivotable original holder 13. The holder 13 is preferably fitted with an underpressure or vacuum system, so that by atmospheric pressure the paste-up may be urged into intimate contact with the flat supporting board of the holder. The holder may be swung about a horizontal pivot axis 14 into a vertical exposure position 15 illustrated in broken lines. In that position the location of the paste-up is at the leftwardly-facing side of the holder according to the drawing, and the image of the paste-up may be projected by a lens 16 onto a reusable photoconductor sheet 17 that is fitted to a sheet holder 18. The sheet 17 and the holder 18 have been illustrated in broken lines in the vertical exposure position since they are pivotable about a pivot axis 19 into an almost horizontal position wherein the processing and the transfer of the toner image occur.

The lighting of the paste-up may occur by means of lamp boxes such as 20 and 21. The lamp box 21 is arranged for pivotal movement out of the path of paste-up holder 13, in order to enable the movement of the paste-up holder between its upper and lower position.

The photoconductor holder 18 forms part of a carriage 22 which is movable along a horizontal path indicated by the dash and dot line 23 which is substantially tangential to a cylindrically curved sheet supporting member 24 onto which a receptor sheet in the form of an uncoated anodized aluminium plate may be fitted.

Aluminium plates of different formats are stored in bins such as 25, 26 and 27, and a plate transfer mechanism 28 that is pivotable at 29, is arranged to transport the desired plate to the member 24. In the case of smaller plate formats, the plates may be loaded in the bins as pairs of plates, and they may be fed to the drum in side by side relationship. A suitable device for gripping and lifting the plates by the mechanism 28 is disclosed in co-pending Patent Application, filed on even date herewith and entitled: "An object holding device of sucker-cup type and sheet dispensing apparatus incorporating same".

The member 24, called hereinafter drum for the sake of simplicity is provided with means for receiving the plate and for clamping it in predetermined position on the periphery of the drum. A suitable construction for the drum that is capable of receiving different sheet formats and of holding them taut against the drum, is disclosed in our co-pending European Patent Application No. 83 200 310.7 filed on Mar. 4, 1983.

The following processing stations are provided for the photoconductor sheet 17.

A corona discharge station 30 for the uniform charging of the photoconductor during its return movement, prior to the image-wise exposure.

A liquid toner developing station 31 wherein the electrostatic charge pattern that remains after the exposure is developed by liquid toner comprising toner particles in a carried liquid, and wherein a reversely rotating roller 32 controls the thickness of the remaining developing liquid. A suitable developing device for this purpose is disclosed in European Patent Application No. 83 200 070.7, filed Jan. 19, 1983.

A rinsing station 33 wherein the photoconductor surface is rinsed with a toner-free liquid, such as isododecane, thereby to clear the background of the image, and wherein a reversely rotating roller 34 controls the thickness of the remaining rinsing liquid layer.

A cleaning station 35 with rotatable resilient cleaning rollers 36 and scraper blades for cleaning the photoconductor during its returning movement. The station may be vertically raised over some centimeters, by means of a mechanism represented diagrammatically by the cylinder 88.

A reconditioning station 37 wherein the photoconductor is flooded with light during its returning movement to prepare it for the next image cycle.

A toner transfer station, indicated by a circle 38 in broken lines, wherein there is means (not shown) for maintaining a suitable potential difference between the photoconductor and the aluminium plate on the drum 24 for causing progressive image-wise transfer of toner onto the aluminium plate during the movement of the photoconductor past the rotating receptor plate.

A drying station 39 and a fixing station 40 for treating the aluminium plate after it has been removed from the drum 24, and transferred to the outlet of the apparatus. The fixing station 40 may be arranged for pivotal movement about an axis 101, so that it may be swung into a horizontal position for discharging the printing plate from the apparatus.

It will be understood that the apparatus comprises many other features such as means controlling the displacements of the photoconductor holder 22, the rotation of the drum 24, the synchronism of the speeds of the photoconductor and the receptor sheet in the transfer station 38, liquid supply means such as 89, pumps, etc. All these measures belong to the state of the art, and they require no further description.

Reference is now made to FIGS. 2, 3 and 4 which show different views of the carriage 22 for transporting the photoconductor sheet 17 along the linear path 23 indicated in FIG. 1. The sheet holding component 18 of the carriage comprises a flat plate which is provided at its upper side with two bearing blocks 43 and 44 whereby the holder is pivotably journalled on a shaft 45 that is fitted in a rectangular sub-frame 46. The sub-frame 46 is provided with pivot pins 47 and 48 whereby it is pivotally connected to two parallel cantilever arms 50 which are rigidly interconnected by a cross-piece 51 to form a U-shaped yoke. The sub-frame can therefore rock in the yoke about axis 49. The yoke is connected by pivot pins 52,53 to a chassis frame 55 so that the yoke can rock in that frame about axis 54. The axes 49 and 54 run parallel with each other and they are moreover situated in a horizontal plane 56 as may be seen in FIG. 4. The cross-piece 52 is provided with a counter-weight 79.

The frame 55 is of massive rigid construction that is guided by rails 57 and 58 on top of vertical walls 69 and 70. The frame is provided at the four corners with brackets 59 through 62 to which twin air-bearing heads such as 63 and 64, and single air-bearing heads such as 65 and 66 are provided. The air bearing heads are self-adjustable whereby they may readily align themselves with the bearing surfaces of the rails. The rail 57 has a V-shaped upper surface, thereby to ensure the lateral guidance as well as the vertical support of the frame 55. The rail 58 has a horizontal supporting surface and therefore affords only vertical support for the frame via the associated air bearings. The air-bearings are connected via flexible hoses, not shown, to an air-pressure supply.

The holder 48 is provided with an arm 71 which has on its free extremity a roller 72. The roller 72 co-operates with a hook-shaped member 73 (see FIG. 3) that is provided at the end of the piston rod 74 of a pneumatic jack 75. Activation of the jack causes the rod 74 to retract so that the roller 72 is pulled downwardly causing the holder 18 to be swung about the shaft 45 into the upright position shown in broken lines in FIG. 1, ready for the exposure of the photoconductor that is fitted to the bottom surface of the holder 22. The holder 18 is provided with an adjustment screw 76 provided in a bracket 77, that abuts a stop 78 fitted to the sub-frame 46. In this way, the holder can be adjusted to bring it into exact parallellism with the rails 57 and 58.

The frame 55 is provided with a bracket 90 supporting an air cylinder 91, the piston rod of which can press downwardly on the counterweight 79 thereby to rock the yoke and thereby raise the sub-frame 46 over a distance of several millimeters. Stop means (not shown)

may be provided, for ensuring that the subframe 46 when so raised, remains truly parallel to the frame 55.

The means for driving of the carriage 22 along the rails 57 and 58, in synchronism with the rotation of the drum 24, has not been illustrated. A suitable driving means is described in our European Patent Application filed on even date herewith and entitled: "Apparatus for transferring xerographic images". As an alternative, the driving means may be of any conventional type, e.g. a rack-and-pinion, or a chain or endless belt drive mechanism, etc.

The position occupied by carriage 22 at the transfer zone 38 is illustrated in FIG. 5 wherein the drum 24 bearing the aluminium plate 80 has been diagrammatically illustrated. This figure shows a photoconductor element 81 in position on the holder 18 and also shows transversely spaced spacing members 82 and 83 for causing the correct spacing of the photoconductor from the surface of the aluminium plate.

The photoconductor element 81 may be in the form of a plastic foil with a photoconductive coating thereon. The element can be secured to the holder 18, e.g. by means of an adhesive. The photoconductor element may alternatively be in some other form, e.g. in the form of a glass plate with a photoconductive layer deposited thereon by vacuum coating, the glass plate being clamped to the holder 18 by suitable means.

The spacing members 82 and 83 may be in the form of thin metal strips of a predetermined thickness. These members are connected to the bottom of the holder 18 along its side margins. The spacing members have been illustrated as very slightly separated from the drum 24, but it will be understood that in actual operation the spacing members will ride in rolling contact with opposed surface portions of the periphery of the drum 24.

The contact pressure is caused by the biasing of the holder 22 towards the drum 24, under the influence of gravity 85 acting on the mass of the holder and the sub-frame 46, diminished by the mass of the counterweight 79.

Any upward or downward movement imparted to the spacing members 82,83 as they follow the co-operating surface portions of the drum causes pivotal movement of the sub-frame 46 and/of or the yoke 50-51, relative to the chassis frame 55. Vertical movement of the spacing members 82,83 in the same direction and to the same extent causes pivotal movement of the yoke about the pivots 52,53; whereas any vertical movement of only one of the spacing members, or any vertical movement of the spacing members to different extents or in different directions, cases pivotal movement of the sub-frame 46 about pivots 47,48 either alone or together with pivotal movement of the yoke about pivots 52,53. Inequalities in the extent or the direction of vertical displacements of the spacing members may be caused by imperfections in the longitudinal profiles of the surfaces of the spacing members or of the co-operating surface portions of the drum, or by imperfections in the drum or its mounting.

Because the pivotal axes 49 and 54 of the sub-frame and the yoke respectively are in the same horizontal plane (see line 56 in FIG. 4) any very small upward or downward displacements of the axis 49, e.g. displacements smaller than 1 mm, occur in a vertical plane 100 which is tangent to a imaginary cylinder 86 having its axis coincident with the pivotal axis 54. Consequently such very small vertical movements do not cause lateral displacements of the holder which would impair the image quality.

An enlarged cross-sectional view of the spacing members arrangement is shown in FIG. 6. Dimensions in the vertical direction are exagerated as compared with horizontal dimensions for the sake of clarity. The spacing between the opposing surface portions (theoretically: opposing lines) of the aluminium plate 80 and the photoconductor 81 is indicated by s. Typical values for said spacing are between 5 and 50 microns.

The operation of the disclosed apparatus is as follows with reference to FIG. 1. Starting with the carriage 22 in a rest position that may be situated approximately over the cleaning station 35, the driving means for the carriage is activated to drive the carriage in the left-hand direction, according to FIG. 1, until it has reached the position shown in FIG. 1. During this transport the cylinder 91 was energized to lift the sub-frame 46 and thereby prevent any contact of the photoconductor with the developing and cleaning station. Corona discharge station 30 uniformly sprays the photoconductor 17 with negative charges during the passage of the photoconductor through that station. When the carriage has reached its end position, the jack 75 is energized to swung the photoconductor holder 18 into the position indicated in broken lines in FIG. 1, so that the image-wise exposure of the photoconductor 17 may proceed. After the exposure, the holder 18 is lowered into its horizontal position, the cylinder 91 is de-energized, and the driving means is reversed so as to drive the carriage at a uniform rate along the successive processing stations. In the developing station 31, the electrostatic charge pattern on the photoconductor is developed by contact with liquid toner at the top of the developing station. The thickness of the liquor toner layer deposited image-wise on the photoconductor is reduced to approximately ten micrometers by the thickness control roller 32. The developed charge image is rinsed in the rinsing station 33, and finally the toner transfer takes place progressively as the photoconductor is conveyed through the toner transfer zone 38.

The level at which the photoconductor sheet 17, or more precisely the spacing members 82 and 83, travel during their movement over the developing and rinsing station is slightly lower than the horizontal tangent plane to the drum 24 at the image transfer zone 38. In that way, lifting of the holder 18 by positive contact of the spacing members with the drum 24 is ensured.

During the progressive transfer of the toner image from the photoconductor 17 onto the aluminium plate, the spacing members on the photoconductor holder 18 keep close contact with the drum. Consequently the holder follows any small deviations of the drum surface from a truly cylindrical path.

When the holder 22 leaves the transfer station the drum continues its rotation.

After the aluminium plate has performed a revolution of approximately 390 angular degrees, the grippers on the drum that hold the leading edge of the plate are released, so that up from the position indicated at 93 the plate leaves the drum and is transported by means, not illustrated, along a path 94 past a drying station 39 where the developer liquid is evaporated, and a fixing station 40 where the toner image is fused into the printing surface of the aluminium plate. The plate is then ready for removal from the apparatus and for an occasional treatment with a liquid lithographic preparation containing a compound enhancing the ink and/or lacquer receptivity of the toner image, and containing further a compound increasing the ink-repelling characteristics of the plate metal. After the plate left the drum 24, the drum continued to rotate until at a plate loading position, indicated at 95, the leading edge of a new plate is fed by the mechanism 28 to the drum. During further rotation of the drum to accept the new plate, the transporting means with the photoconductor is returned to its position at the left-hand side of FIG. 1.

During said returning movement, the light source 37 is energized to uniformly expose the photoconductor, and the cleaning station 35 is made operative by its raising by the cylinder 88, thereby to contact the photoconductor during its returning motion and flush away some remuant toner particles.

The following data illustrate the apparatus described hereinbefore:

size of photoconductor: 915×635 mm
type of photoconductor: a polymeric support onto which an
electrically conductive layer and an anorganic photoconductor layer are provided
aluminium plate formats:
280×461 mm
396×576 mm
627×915 mm
mass of the holder 22 and the sub-frame 46: 73 kgs
mass of the counterweight: 36 kgs
remaining mass causing the biasing of the photoconductor sheet towards the receptor sheet: 0.1 kg
distance s established by the spacing members: 30 microns.

The invention is not limited to the described embodiment of the apparatus. Another arrangement for the spacing members is illustrated in FIG. 7. In this arrangement, the spacing members are in the form of electrically conductive strips 95 and 96 that are directly fitted onto the surface of the photoconductor element 81. The strips are electrically conductive, since otherwise they would become electrically charged by the corona discharge station 30. Suitable thicknesses for the strips are between 20 and 30 microns. The strips bear on marginal zones of the aluminium plate 24 so that they do not interfere with the image portions of the plate.

A still further alternative is one wherein, unlike as in the FIG. 6 illustration, the spacing members are fitted on the drum periphery, and co-operate with corresponding marginal zones of the photoconductor holder, or even with the photoconductor itself.

It will be understood that the angular portion of the drum onto which the spacing members are fitted, or that co-operates with spacing members fitted to the linearly moving transporting member, must not necessarily extend over 360 angular degrees. As a matter of fact, the angular extent of the aluminium plate covers usually less than 360, and even less than 180 angular degrees, and it is over this angular extent only that gap control is necessary. In the case of a cylindrical plate holder that is suited for different plate formats, as is the case for the apparatus disclosed in the Application referred to hereinbefore, the length of the spacing members is necessarily chosen as adequate for the largest plate format.

The spacing members need not necessarily be in the form of separate strips, as disclosed hereinbefore. As an alternative they may be formed "in situ" by elevated rim portions of one or the other, or both, of the transporting members that co-operate at the toner transfer station. For instance, in the FIG. 6 embodiment the spacing members 82 and 83 may be integral with the holder 22, and be formed to the required thickness at the production stage at which the photoconductor bearing surface of the holder 22 is ground.

The developing and rinsing stations 31 and 33 may be arranged for vertical displacements to keep clear of the photoconductor during the returning movement thereof after the toner transfer, rather than displacing the photoconductor upwardly by means of the cylinder 91 as disclosed hereinbefore.

The biasing of the photoconductor element towards the receptor sheet may occur otherwise than by gravity, for instance by spring means.

Finally, the exposure of the photoconductor sheet need not necessarily occur by integral exposure as described in the embodiment, but the exposure may occur also linewise, for instance by scanning the charged photoconductor sheet as it starts to travel along the path 23 by means of a modulated laser beam, or by exposing the sheet to an elongate exposure head comprising a great plurality of LED's, mounted just ahead of the developing station 31. In this way, signals representing textual matter or pictorial images can be electronically generated, permitting gradation control, character control, image reversal, etc.

I claim:

1. Apparatus for transferring an electrophotographic toner image from the surface of a first image-donating element to the surface of a second image-receiving element, said apparatus comprising a rotatable member having a cylindrically curved periphery for supporting one of said elements in cylindrically curved condition, concentric with the axis of rotation of said rotatable member, and means for conveying the other element, synchronously with said one element, through an image transfer station traversed by the path of motion of said curved periphery of said rotatable member, said station comprising means for forming an electrical potential gradient for effecting such toner image transfer, said conveying means comprising a bodily displaceable carriage having a holder for holding said one element in substantially flat condition; means for guiding said carriage for movement along a path extending in close spaced proximity to said rotatable member for conveying said one element through the image transfer station; and spacer strips of predetermined thickness located adjacent the lateral end edges of one of the cylindrically curved periphery of said rotatable member or the flat surface of said sheet holder for making contact at the image transfer station with the other of said holder surface or said rotatable member periphery and thereby establish a predetermined gap between the said image-donating and image-receiving surfaces; and means for biasing said holder toward said member periphery to maintain said spacer strips under contact pressure during passage through the image transfer station.

2. Apparatus according to claim 1, including means for mounting said holder on said carriage for free pivotal movement relative to the carriage about an axis parallel with the path of the carriage.

3. Apparatus according to claim 2, wherein said axis is in a plane of symmetry of said holder.

4. Apparatus according to claim 2, wherein said carriage includes a supporting frame in which said element holder is pivoted and means for mounting said supporting frame itself in said carriage for free pivotal movement relative to said carriage about an axis parallel with the pivot axis of said element holder.

5. Apparatus according to claim 4, wherein said axes are in a common plane parallel with the axis of rotation of said rotatable member.

6. Apparatus according to claim 4, wherein the said path of the carriage extends above the rotatable member and said biasing means for maintaining the spacer strips under contact pressure during passage through the image transfer station is gravitational force which tends to pull said holder downwardly about the pivotal axis of said holder supporting frame, and includes a counterweight which partly counterbalances the weight which is pivotally supported by such supporting frame.

7. Apparatus according to claim 1, wherein said spacer strips are located directly on said element holder for holding.

8. Apparatus according to claim 1, wherein said spacer strips are releasably attached to said element holder.

9. Apparatus according to claim 1, wherein said element holder is pivotally mounted in said carriage for swinging movement to and from a substantially horizontal image-transfer position from and to a raised vertical position in which a photoconductive element attached to the bottom of such holder can be conveniently image-wise exposed to light.

10. Apparatus according to claim 1, including means for gripping a photoconductor sheet on said element holder of said carriage, and means for releasably holding a receptor sheet against the cylindrically curved periphery of said rotatable member.

11. Apparatus according to claim 10, wherein said receptor sheet is an aluminium or other metal printing plate blank.

12. Apparatus according to any claim 1, wherein said carriage is supported by said guide means on air bearings.

13. Apparatus according to claim 1, which includes means located for applying developing toner to said image-donating element while such element is being conveyed by said carriage towards said rotatable member preparatory to toner image transfer.

* * * * *

UNITED STATES PATENT AND TRADEMARK OFFICE

CERTIFICATE OF CORRECTION

PATENT NO. : 4,515,461

DATED : May 7, 1985

INVENTOR(S) : LEO N. VACKIER

It is certified that error appears in the above-identified patent and that said Letters Patent is hereby corrected as shown below:

Claim 7, line 2, a period should be inserted after "holder" and the remainder of the claim cancelled.

Signed and Sealed this

*Twentieth* Day of *August 1985*

[SEAL]

*Attest:*

DONALD J. QUIGG

*Attesting Officer*

*Acting Commissioner of Patents and Trademarks*